US011786040B1

(12) United States Patent
Porter

(10) Patent No.: US 11,786,040 B1
(45) Date of Patent: Oct. 17, 2023

(54) RECLINER CHAIR WITH OBJECT SENSOR AND ALERT

(71) Applicant: Russell Porter, New York, NY (US)

(72) Inventor: Russell Porter, New York, NY (US)

( * ) Notice: Subject to any disclaimer, the term of this patent is extended or adjusted under 35 U.S.C. 154(b) by 0 days.

(21) Appl. No.: 17/666,167

(22) Filed: Feb. 7, 2022

(51) Int. Cl.
*A47C 1/02* (2006.01)
*A47C 7/72* (2006.01)
*G08B 7/00* (2006.01)

(52) U.S. Cl.
CPC ..... *A47C 7/727* (2018.08); *A47C 1/02* (2013.01); *A47C 7/725* (2013.01); *G08B 7/00* (2013.01)

(58) Field of Classification Search
CPC ... A61G 2203/726; A47C 1/02; G05B 19/048
USPC ..... 297/69, 71, 75, 89
See application file for complete search history.

(56) References Cited

U.S. PATENT DOCUMENTS

| | | | | |
|---|---|---|---|---|
| 3,083,996 | A | 4/1963 | Caldemneyer et al. | |
| 4,660,883 | A | 4/1987 | Kowalski | |
| 10,285,649 | B1 * | 5/2019 | Murray | G01C 21/3461 |
| 11,071,385 | B2 * | 7/2021 | Womack | A47C 7/506 |
| 2014/0265502 | A1 * | 9/2014 | Hough | A61G 5/1035 280/47.38 |
| 2016/0166453 | A1 * | 6/2016 | Furman | A61G 7/015 700/275 |
| 2017/0293281 | A1 * | 10/2017 | Li | A47C 1/0242 |
| 2020/0253379 | A1 * | 8/2020 | Song | A47C 1/03211 |

* cited by examiner

*Primary Examiner* — Sarah B McPartlin
(74) *Attorney, Agent, or Firm* — SANCHELIMA & ASSOCIATES, P.A.; Christian Sanchelima; Jesus Sanchelima

(57) ABSTRACT

A recliner chair with object sensor and alert including a recliner chair assembly and an alarm assembly. The recliner chair assembly includes a footrest that can be lifted. The alarm assembly includes a speaker and a sensor. The sensor is configured to detect a pet, a person or an object under the footrest. The speaker emits an audible alarm when the sensor detects an object under the footrest to prevent a user sat in the recliner chair from closing the footrest, thereby preventing the pet, or the person under the foot rest from getting hurt.

6 Claims, 4 Drawing Sheets

RECLINER CHAIR WITH OBJECT SENSOR AND ALERT

BACKGROUND OF THE INVENTION

1. Field of the Invention

The present invention relates to recliner chairs and, more particularly, to a recliner chair with object sensor and alert.

2. Description of the Related Art

Several designs for recliner chairs have been designed in the past. None of them, however, include an object sensor located on the bottom of the foot rest to detect a pet, a person or an object under the rest.

Applicant believes that a related reference corresponds to U.S. Pat. No. 4,660,883 issued for a safety platform placed under the foot rest of a reclining chair to prevent a person or animal from being injured if they are under the foot rest when it closes. Applicant believes that another related reference corresponds to U.S. Pat. No. 3,083,996 issued for a reclining chair with elevating foot rest. None of these references, however, teach of a recliner chair with object sensor and alert that can detect a pet, a person or an object under the foot rest when opened and will emit an alert to prevent the foot rest from closing on the object.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a recliner chair with object sensor and alert that includes a sensor to detect toddlers, pets or objects under the foot rest.

It is another object of this invention to provide a recliner chair with object sensor and alert that emits an alarm to alert that a pet, a person or an object is under the foot rest when the foot rest is elevated.

It is still another object of the present invention to provide a recliner chair with object sensor and alert that prevents a user sat on the chair from closing the foot rest.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
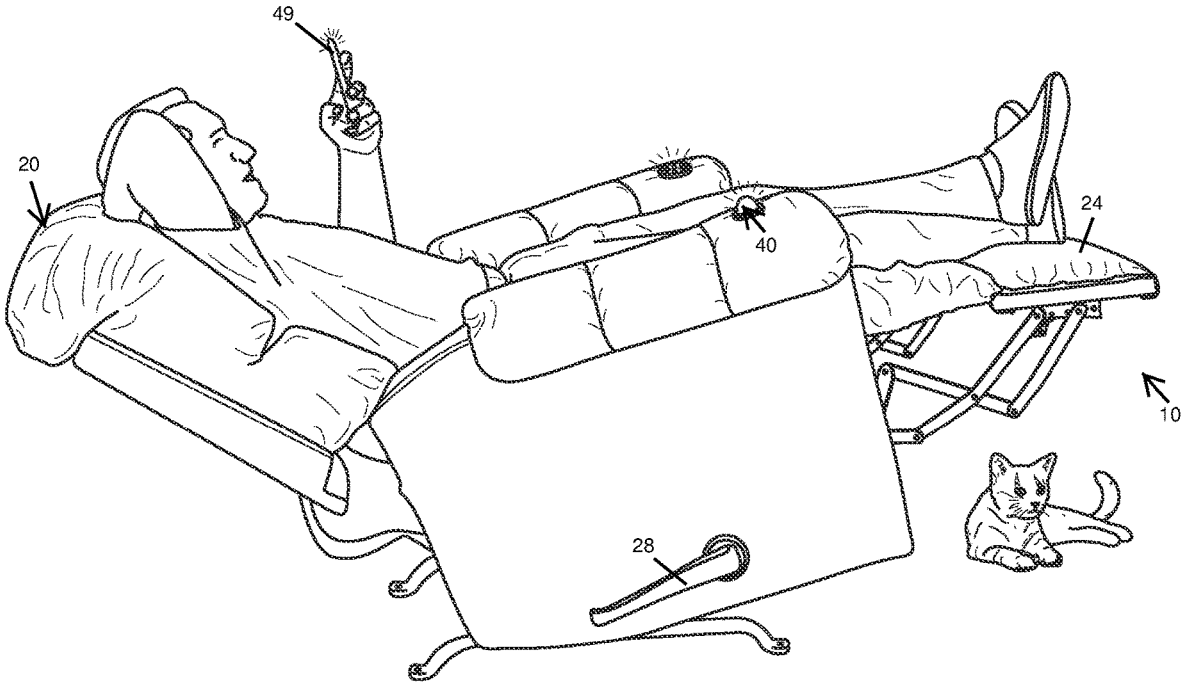
FIG. 1 represents an isometric operational view of the present invention 1. A pet is under the footrest 24 activating the alarm assembly 40 to aware a user of the presence of the pet.
Figure 2:
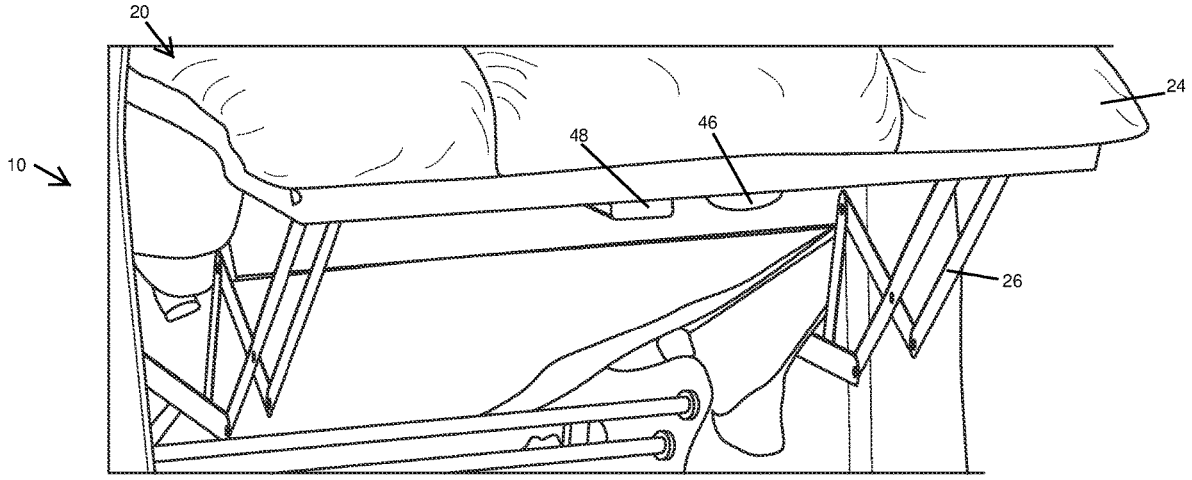
FIG. 2 shows an enlarge view of the footrest 24 showing the at least one sensor 46 attached to a lower portion of the footrest 24.
Figure 3:
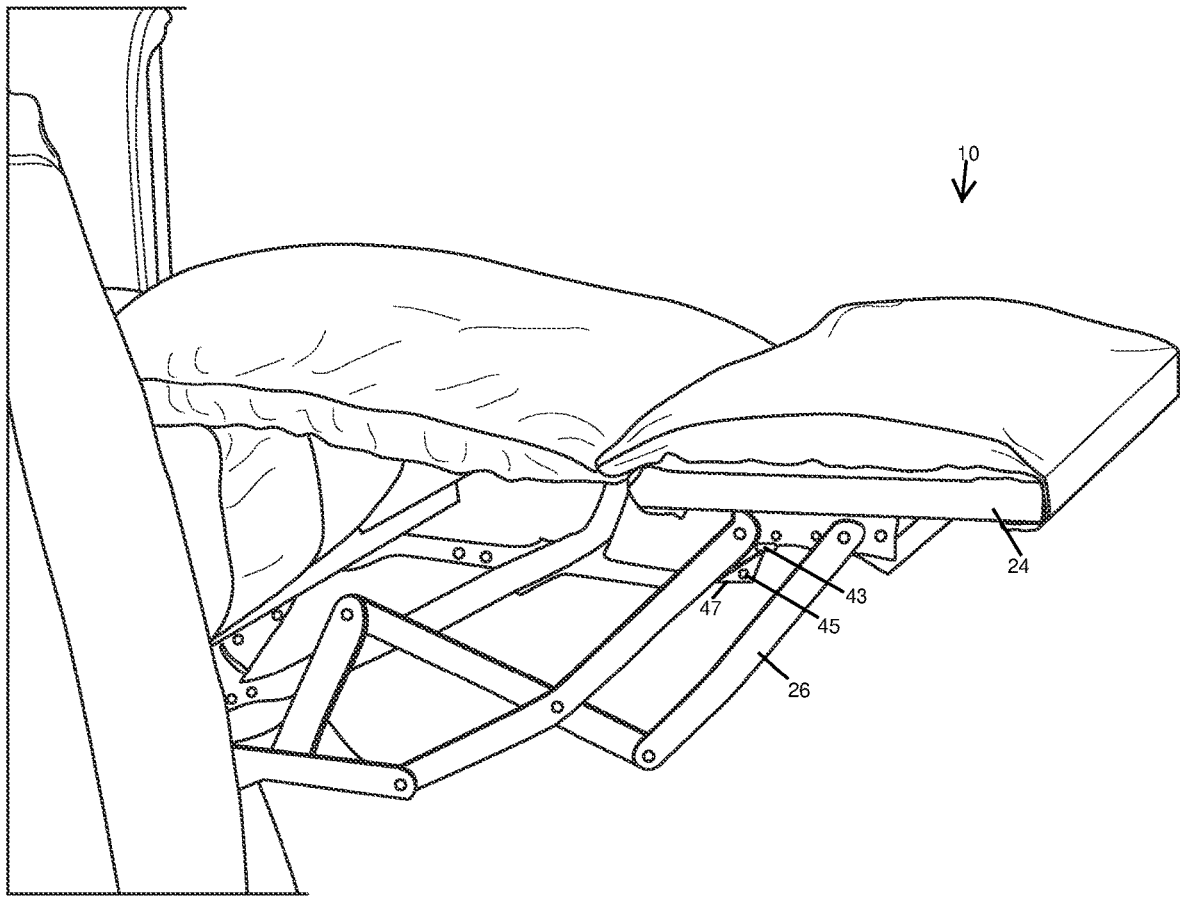
FIG. 3 illustrates a lateral view of the footrest 24 the footrest mechanism 26 and the lock mechanism 45 attached to the footrest mechanism 26.
Figure 4:
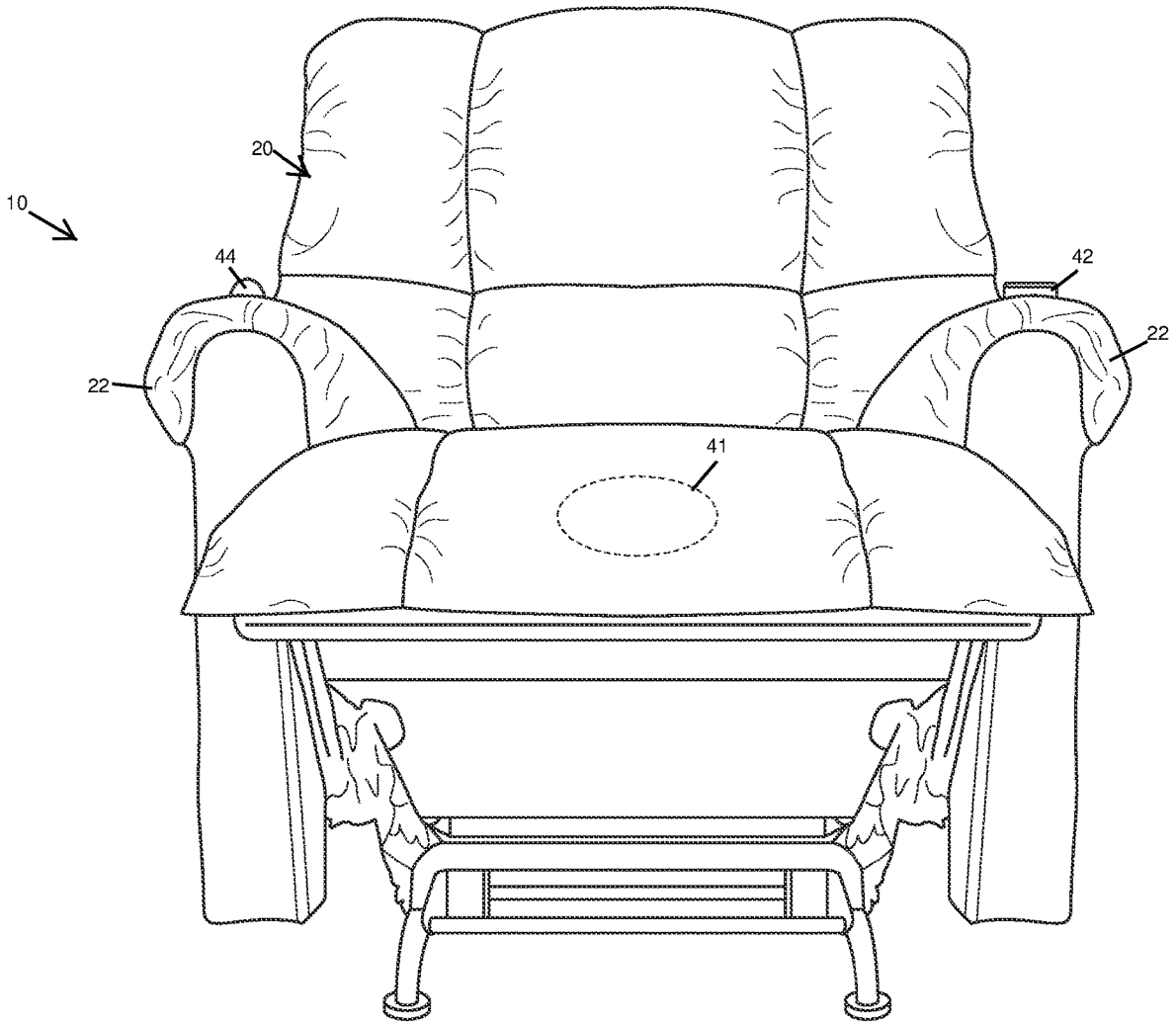
FIG. 4 is a representation of a front view of the recliner chair assembly 20 showing the at least one speaker 42, the at least one light 44 and the vibrator 41.

Referring now to the drawings, where the present invention is generally referred to with numeral 10, it can be observed that it basically includes a recliner chair assembly 20 and an alarm assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Recliner chair assembly 20 may be a traditional recliner, a power recliner, a rocker recliner, a glide recliner, a push-back recliner, a swivel recliner, a lift recliner, a wall-hugger recliner or any other recliner chair known in the prior art. Recliner assembly 20 may include armrests 22. The recliner assembly includes footrest 24. The recliner chair assembly 20 may further include footrest mechanism 26 that can elevate the footrest 24. The footrest mechanism 26 may be connected to the footrest 24. The recliner chair assembly 20 may also include a lever 28 to actuate the footrest mechanism 26 to elevate the footrest 24. The lever 28 may be connected to the footrest mechanism 26. The lever 28 may be a pull handle, or any suitable kind of lever. The lever 28 may be coupled to one side of the recliner assembly 20. The footrest mechanism 26 may be actuated with the lever 28 or with a motorized actuator. The motorized actuator may be operatively connected to the footrest mechanism 28. The motorized actuator may allow to actuate the footrest mechanism 26 to gradually elevate the footrest 24. The footrest mechanism 26 may be push downwardly by the weight of feet to lower the footrest 24. It also may be suitable to use a motorized actuator to lower the footrest 24 by actuating the footrest mechanism 26. Motorized actuator may be an electric motor, hydraulic cylinders, pneumatic motor, pneumatic cylinders, or any other suitable actuator. The motorized actuator may be controlled by a control to set any desired position for the footrest. It should be understood that the aforementioned elements that the recliner chair assembly 20 may include are for explanatory purposes only, and do not limit the recliner chair assembly 20 to include exclusively the aforementioned elements.

Alarm assembly 40 may be installed to recliner chair assembly 20. It should be understood that any recliner chair may be retrofitted with the alarm assembly 40. It also may be suitable to have the recliner chairs manufactured with the alarm assembly 40. The alarm assembly 40 may include at least one speaker 42, at least one light 44, at least one sensor 46 and a battery 48. In one embodiment, the at least one sensor 46 may be attached to a lower side of the footrest 24. In a preferred embodiment, the at least one sensor 46 may be a presence detection sensor such as an ultrasonic sensor, an infrared sensor, a laser sensor, any suitable photoelectric sensor, or any other suitable kind of presence detection sensor to detect an object, a pet or an infant under the footrest 24. It also may be suitable to use a camera or a LIDAR scanner to detect if an object is under the footrest and further the sensor may be processed by a microprocessor to detect what the object is. It also may be suitable to place a sensor on a portion of the floor directly under the footrest with a capacitive sensor, a pressure sensor, a force sensor or any other suitable kind of sensor that can detect the object, pet or infant by touching, weight or pressure. It also may be suitable to have the at least one sensor 46 being a temperature sensor characterized to detect objects with a temperature different than the environment temperature. It also may be suitable to make the pets of a house having a metal tag and an inductive proximity sensor used as the at least one sensor 46. The inductive proximity sensor may detect the presence of the pet by detecting the metal tag. It should be understood that the at least one sensor 46 may be placed around the area under the footrest 24 in such a way that the at least one sensor 46 may detect if there is an object, pet or infant under the footrest 24. It also may be suitable to install multiple sensors of same or different type for implementing a robust detection system such that if a sensor fails other sensor may detect the presence of the object, pet or infant.

In one embodiment the at least one speaker 42 may be mounted to one of the armrests 22. It should be understood that the at least one speaker 42 may be mounted also at the footrest 24 or anywhere else on the recliner chair assembly 20. The at least one light 44 may be mounted to another of the armrests 22 or anywhere else on the recliner chair assembly 20. It also may be suitable to have at least one light 44 and the at least one speaker 42 mounted aside one to each other. The at least one light 44 may be a LED light, a neon lamp, a halogen lamp, an incandescent lamp or any variation thereof. The at least one light 44 may be connected by electrically wired to the at least one sensor 46. It also may be suitable to wirelessly communicate the at least one sensor with the at least one light 44. The at least one light 44 may emit a visual alert when the at least one sensor 46 detects an object, a pet or an infant under the footrest 24. The at least one speaker 42 may be connected by electrically wired to the at least one sensor 46. It also may be suitable to wirelessly communicate the at least one sensor with the at least one speaker 42. The at least one sensor 46 may sound the speaker 42 to emit an audible alarm indicating that an object, infant or pet is under the footrest. The at least one speaker 42 and the at least one light 44 may alert to a user resting above the recliner chair assembly 40.

The battery 48 may be attached lower side of the footrest 24. It also may be suitable to have the battery 48 mounted anywhere else on the recliner chair assembly 20. The battery 48 may be a rechargeable battery or a non-rechargeable battery. The battery 48 may provide energy to the alarm assembly 40. The alarm assembly 40 may further include a vibrator 41 embedded to the footrest 24 or mounted beneath the footrest 24. The vibrator 41 may be driven by the at least one sensor 46. The at least one sensor 46 may actuate the vibrator 42 when an object or pet is detected under the footrest 24 to alert a user preventing the user of closing the footrest against the object pet or infant. The alarm assembly 40 may further include a lock mechanism 45. In one embodiment, the lock mechanism 45 may be mounted to a lock support 47. The lock support 47 may be attached to one support bar of the footrest mechanism 26 using a fastener 43. It also may be suitable to attach the lock support 47 to the footrest mechanism 26 with welding, rivets, bolts or the like. The lock mechanism 45 may be a linear member that can linearly protrude from the lock support 47 blocking the rotation of one of the bars of the footrest mechanism 26. The lock mechanism 45 may also have an angular member that rotates to block the path of one of the bars of the footrest mechanism 26. The lock mechanism 45 may be wired to the at least one sensor 46. It also may be suitable to wirelessly communicate the lock mechanism 45 with the at least one sensor 46. The at least one sensor 46 may actuate the lock mechanism 45 when an object, pet or infant is detected under the footrest 24 to block the footrest mechanism 26 impeding the footrest 24 to be folded down and injuring the infant or pet. It should be understood that the lock mechanism 45 may be implemented in other mechanisms of the recliner chair assembly such as a lock mechanism for the motor, for the lever or the like. The at least one sensor 46 may also be configured to wirelessly communicate with an electronic portable device 49 such as a smartphone, tablet or the like to aware a user when the at least one sensor 46 detects a pet, infant or object.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A recliner chair with object sensor and alert, comprising:

A) a recliner chair having a footrest, an armrest, a lever, and a footrest mechanism, wherein said footrest mechanism is able to elevate said footrest when said lever is manually actuated, said lever is mechanically connected to said footrest mechanism;

B) an alarm assembly including at least one speaker, at least one sensor, and at least one light, wherein the at least one sensor is located under the footrest, wherein the at least one speaker emits an audible alarm when the at least one sensor detects an object under the footrest when the footrest is elevated, wherein said at least one light is mounted on said armrest, said at least one light emits a visual alert when the at least one sensor detects the object under the footrest, wherein said alarm assembly further includes a battery to provide energy to said alarm assembly, said alarm assembly further includes a lock support, a lock mechanism, an electronic portable device, a fastener, and a vibrator, wherein said lock support is fixed to said footrest mechanism by means of said fastener, wherein said lock mechanism is a linear member that protrudes from said lock support to block said footrest mechanism when elevated, said vibrator is integrated within said foot rest and electrically connected to said at least one sensor, said electronic portable device is wirelessly connected to said at least one sensor.

2. The recliner chair with object sensor and alert set forth in claim 1, wherein said at least one sensor is a presence detection sensor electrically connected to said lock mechanism.

3. The recliner chair with object sensor and alert set forth in claim 1, wherein said vibrator is actuated when the at least one sensor detects the object under the footrest.

4. The recliner chair with object sensor and alert set forth in claim 1, wherein said lock mechanism blocks said footrest mechanism to prevent said footrest from being closed when the at least one sensor detects the object under the footrest.

5. The recliner chair with object sensor and alert set forth in claim 1, wherein said at least one sensor wirelessly communicates with said electronic portable device to alert a user that the object is under the footrest.

6. A recliner chair with object sensor and alert, consisting of:

A) a recliner chair assembly having a footrest, an armrest, a lever, and a footrest mechanism, wherein said footrest mechanism is able to elevate said footrest when said lever is manually actuated, said lever is mechanically connected to said footrest mechanism;

B) an alarm assembly including at least one light, a battery, a lock mechanism, at least one speaker and at least one sensor, an electronic portable device, a fastener, and a vibrator, wherein the at least one sensor is located under the footrest, wherein the at least one speaker and said at least one light are mounted on said armrest, wherein the at least one speaker emits an audible alarm when the at least one sensor detects an object under the footrest when the footrest is elevated, said battery provides energy to the alarm assembly, said battery is a rechargeable battery that is attached to the footrest, said at least one light emits a visual alarm when the at least sensor detects an object under the footrest, said lock mechanism is attached to a lock support, wherein said lock support is attached to the footrest mechanism, said lock mechanism is electrically connected to said at least one sensor to prevent said footrest mechanism for closing when the at least one sensor detects the object under the footrest, wherein said lock support is fixed to said footrest mechanism by means of said fastener, wherein said lock mechanism is a linear member that protrudes from said lock support to block said footrest mechanism when elevated, said vibrator is integrated within said foot rest and electrically connected to said at least one sensor, said vibrator is actuated when said at least one sensor detects said object under said footrest, said electronic portable device is wirelessly connected to said at least one sensor to alert the user when the object is positioned under said footrest.

* * * * *